US011739469B2

(12) United States Patent
Ayers et al.

(10) Patent No.: US 11,739,469 B2
(45) **Date of Patent: *Aug. 29, 2023**

(54) INTEGRATED SINGLE DOSE AND BULK DISPENSER FOR A LAUNDRY TREATING APPLIANCE

(71) Applicant: WHIRLPOOL CORPORATION, Benton Harbor, MI (US)

(72) Inventors: Kevin B. Ayers, Saint Joseph, MI (US); Seth E. Bixby, Stevensville, MI (US); Richard K. Gresens, Saint Joseph, MI (US); Sayer J. Murphy, Saint Joseph, MI (US); Anna C. Schelling, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 94 days.

This patent is subject to a terminal disclaimer.

(21) Appl. No.: 17/392,527

(22) Filed: Aug. 3, 2021

(65) Prior Publication Data

US 2021/0363682 A1 Nov. 25, 2021

Related U.S. Application Data

(60) Division of application No. 16/287,466, filed on Feb. 27, 2019, now Pat. No. 11,105,033, which is a continuation of application No. 15/216,842, filed on Jul. 22, 2016, now Pat. No. 10,253,444.

(51) Int. Cl.
*D06F 39/02* (2006.01)
*D06F 35/00* (2006.01)

(52) U.S. Cl.
CPC ..... *D06F 39/022* (2013.01); *D06F 35/006* (2013.01); *D06F 39/02* (2013.01)

(58) Field of Classification Search
CPC ..... D06F 35/006; D06F 39/02; D06F 39/022
See application file for complete search history.

(56) References Cited

U.S. PATENT DOCUMENTS

| | | | |
|---|---|---|---|
| 3,033,427 | A | 5/1962 | Petersen |
| 4,160,367 | A | 7/1979 | Vona, Jr. |
| 4,265,100 | A | 5/1981 | Kretchman et al. |
| 6,434,977 | B1 | 8/2002 | Hapke et al. |
| 8,813,526 | B2 | 8/2014 | Doyle et al. |
| 9,863,082 | B1 | 1/2018 | Ayers et al. |
| 9,988,754 | B2 | 6/2018 | Kakaraparthi |
| 2010/0000022 | A1 | 1/2010 | Hendrickson et al. |
| 2010/0000586 | A1 | 1/2010 | Hendrickson |
| 2011/0067456 | A1 | 3/2011 | Quandt |
| 2013/0160500 | A1 | 6/2013 | Hendrickson |
| 2013/0263631 | A1 | 10/2013 | D'Andrea et al. |
| 2015/0330013 | A1 | 11/2015 | Miller |

FOREIGN PATENT DOCUMENTS

| | | | |
|---|---|---|---|
| EP | 2381027 | A1 | 10/2011 |
| WO | 2015043860 | A1 | 4/2015 |

OTHER PUBLICATIONS

European Search Report for Counterpart EP17182462.6, dated Dec. 18, 2017.

*Primary Examiner* — Joseph L. Perrin
(74) *Attorney, Agent, or Firm* — McGarry Bair PC

(57) ABSTRACT

A laundry treating appliance for treating laundry according to an automatic cycle of operation includes a treating chamber and a dispenser fluidly coupled to the treating chamber. The dispenser has a single dose reservoir, a bulk dispensing reservoir, and an overflow fluidly coupling the single dose reservoir to the bulk dispensing reservoir.

20 Claims, 9 Drawing Sheets

INTEGRATED SINGLE DOSE AND BULK DISPENSER FOR A LAUNDRY TREATING APPLIANCE

CROSS-REFERENCE TO RELATED APPLICATION(S)

This application is a divisional application of U.S. patent application Ser. No. 16/287,466, filed Feb. 27, 2019, now U.S. Pat. No. 11,105,033, issued Aug. 31, 2021, which is a continuation application of U.S. patent application Ser. No. 15/216,842, filed Jul. 22, 2016, now issued as U.S. Pat. No. 10,253,444, on Apr. 9, 2019, both of which are incorporated herein by reference in their entirety.

BACKGROUND

Laundry treating appliances, such as washing machines, refreshers, and non-aqueous systems, can have a configuration based on a rotating drum that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation. The laundry treating appliance can have a dispenser for loading of treating chemistries into the appliance by the user and for supplying various treating chemistries to the treating chamber.

BRIEF SUMMARY

In one aspect, the description relates to a laundry treating appliance for treating laundry according to an automatic cycle of operation. The laundry treating appliance comprises a treating chamber, a bulk treating chemistry reservoir, a dispenser fluidly coupled to the treating chamber and movable between an opened position and a closed position. The dispenser comprises a single dose reservoir having at least a bottom wall and a side wall and an overflow provided within the bottom wall or the side wall and overlying the bulk treating chemistry reservoir when the dispenser is in the opened position and wherein the bulk treating chemistry reservoir can be filled by overfilling the single dose reservoir when the dispenser is in the opened position In another aspect, the disclosure relates to a dispenser movable between an opened position and a closed position, the dispenser comprising: a single dose reservoir having at least a bottom wall and a side wall, a bulk dispensing reservoir located remotely from the single dose reservoir, and an overflow provided within the bottom wall or the side wall and overlying the bulk treating chemistry reservoir when the dispenser is in the opened position and wherein the bulk treating chemistry reservoir can be filled by overfilling the single dose reservoir when the dispenser is in the opened position.

DETAILED DESCRIPTION

Laundry treating appliances can be provided with both single dose dispensers and bulk dispensers. Providing the structures and reservoirs for both a single dose dispenser and a bulk dispenser can require the use of additional space within the laundry treating appliance, as well as additional manufacturing costs. Integrated single dose and bulk dispensers in accordance with the present disclosure enable efficient use of space within the laundry treating appliance and eliminate the need for a user to load treating chemistries into different cups or through different access openings. In one aspect, this is achieved by providing an overflow to fluidly couple a single dose reservoir to a bulk dispensing reservoir.

Figure 1:
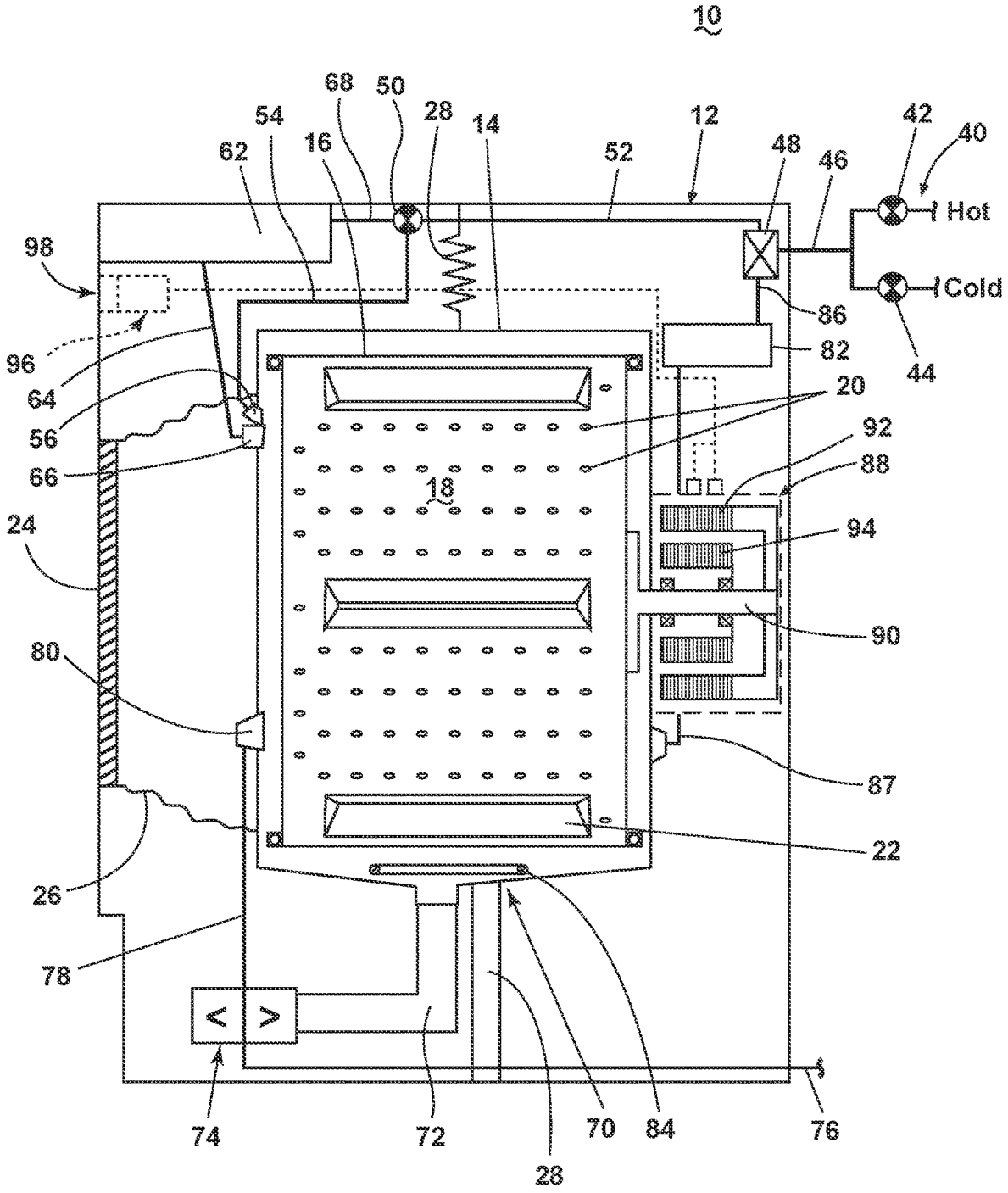
FIG. 1 illustrates a schematic cross-sectional view of a laundry treating appliance in the form of a washing machine according to an embodiment of the present disclosure.

FIG. 1 is a schematic cross-sectional view of a laundry treating appliance according to an embodiment of the present disclosure. The laundry treating appliance can be any appliance which performs an automatic cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a horizontal axis washing machine 10, which can include a structural support system comprising a cabinet 12 which defines a housing within which a laundry holding system resides. The cabinet 12 can be a housing having a chassis and/or a frame, to which decorative panels can or can not be mounted, defining an interior enclosing components typically found in a conventional washing machine, such as motors, pumps, fluid lines, controls, sensors, transducers, and the like. Such components will not be described further herein except as necessary for a complete understanding of the present disclosure.

The laundry holding system comprises a tub 14 supported within the cabinet 12 by a suitable suspension system and a drum 16 provided within the tub 14, the drum 16 defining at least a portion of a laundry treating chamber 18. The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding system to comprise only one receptacle with the receptacle defining the laundry treating chamber for receiving the load to be treated.

The laundry holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14.

The washing machine 10 can further include a suspension system 28 for dynamically suspending the laundry holding system within the structural support system.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The washing machine 10 can also be provided with a dispensing system for dispensing treating chemistry to the treating chamber 18 for use in treating the laundry according to a cycle of operation. The dispensing system can include a dispenser 62 which can be a single dose dispenser, a bulk dispenser, or an integrated single dose and bulk dispenser and is fluidly coupled to the treating chamber 18. The dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the dispenser 62 from the supply conduit 52 by directing the diverter mechanism 50 to direct the flow of water to a dispensing supply conduit 68.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The washing machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The washing machine 10 also includes a control system for controlling the operation of the washing machine 10 to implement one or more cycles of operation. The control system can include a controller 96 located within the cabinet 12 and a user interface 98 that is operably coupled with the controller 96. The user interface 98 can include one or more knobs, dials, switches, displays, touch screens and the like for communicating with the user, such as to receive input and provide output. The user can enter different types of information including, without limitation, cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
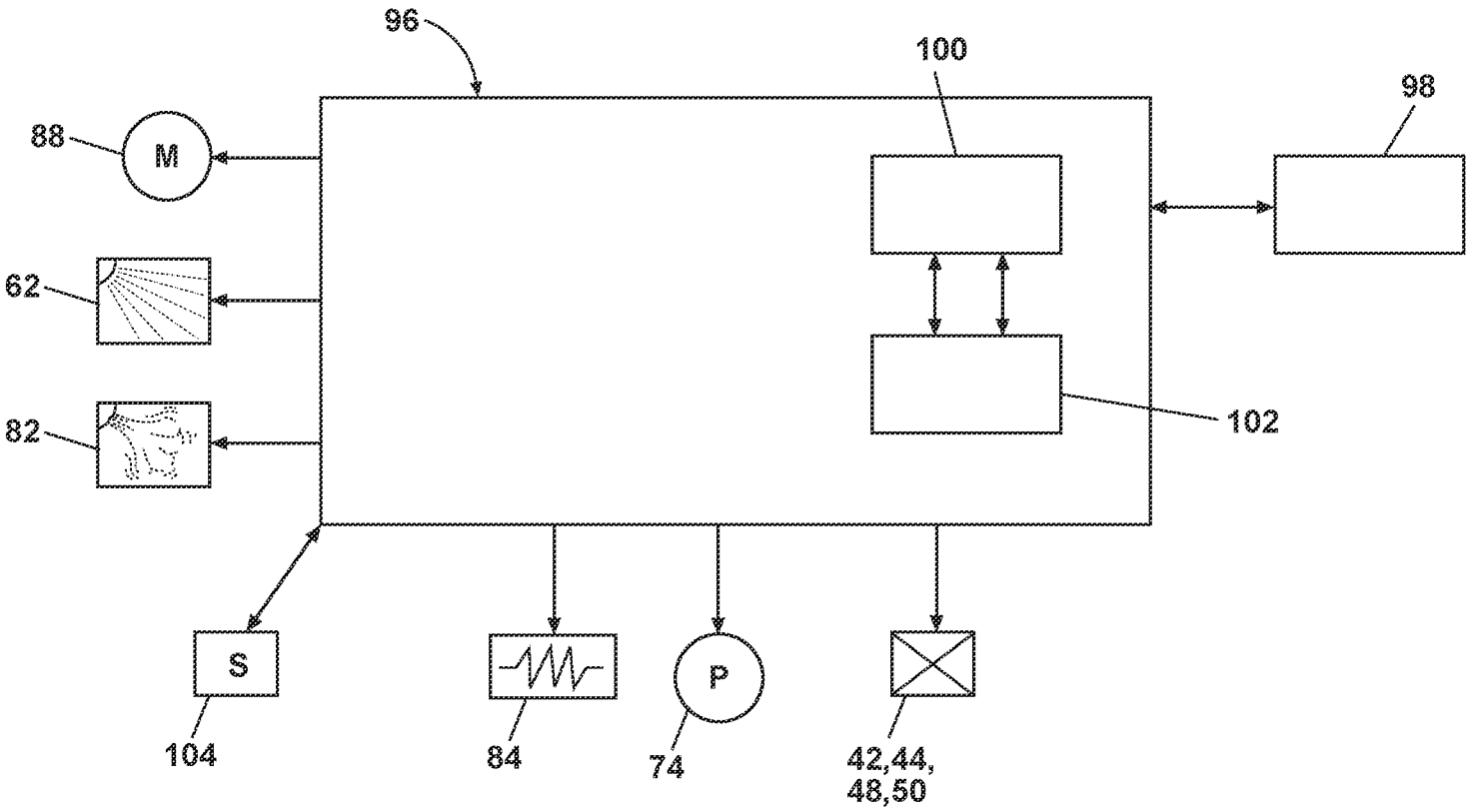
FIG. 2 illustrates a schematic of a control system of the laundry treating appliance of FIG. 1 according to an embodiment of the present disclosure.

As illustrated in FIG. 2, the controller 96 can be provided with a memory 100 and a central processing unit (CPU) 102. The memory 100 can be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 can also be used to store information, such as a database or table, and to store data received from one or more components of the washing machine 10 that can be communicably coupled with the controller 96. The database or table can be used to store the various operating parameters for the one or more cycles of operation, including factory default values for the operating parameters and any adjustments to them by the control system or by user input.

The controller 96 can be operably coupled with one or more components of the washing machine 10 for communicating with and controlling the operation of the component to complete a cycle of operation. For example, the controller 96 can be operably coupled with the motor 88, the pump 74, the dispenser 62, the steam generator 82 and the sump heater 84 to control the operation of these and other components to implement one or more of the cycles of operation.

The controller 96 can also be coupled with one or more sensors 104 provided in one or more of the systems of the washing machine 10 to receive input from the sensors, which are known in the art and not shown for simplicity. Non-limiting examples of sensors 104 that can be communicably coupled with the controller 96 include: a treating chamber temperature sensor, a moisture sensor, a weight sensor, a chemical sensor, a position sensor and a motor torque sensor, which can be used to determine a variety of system and laundry characteristics, such as laundry load inertia or mass.

Figure 3:
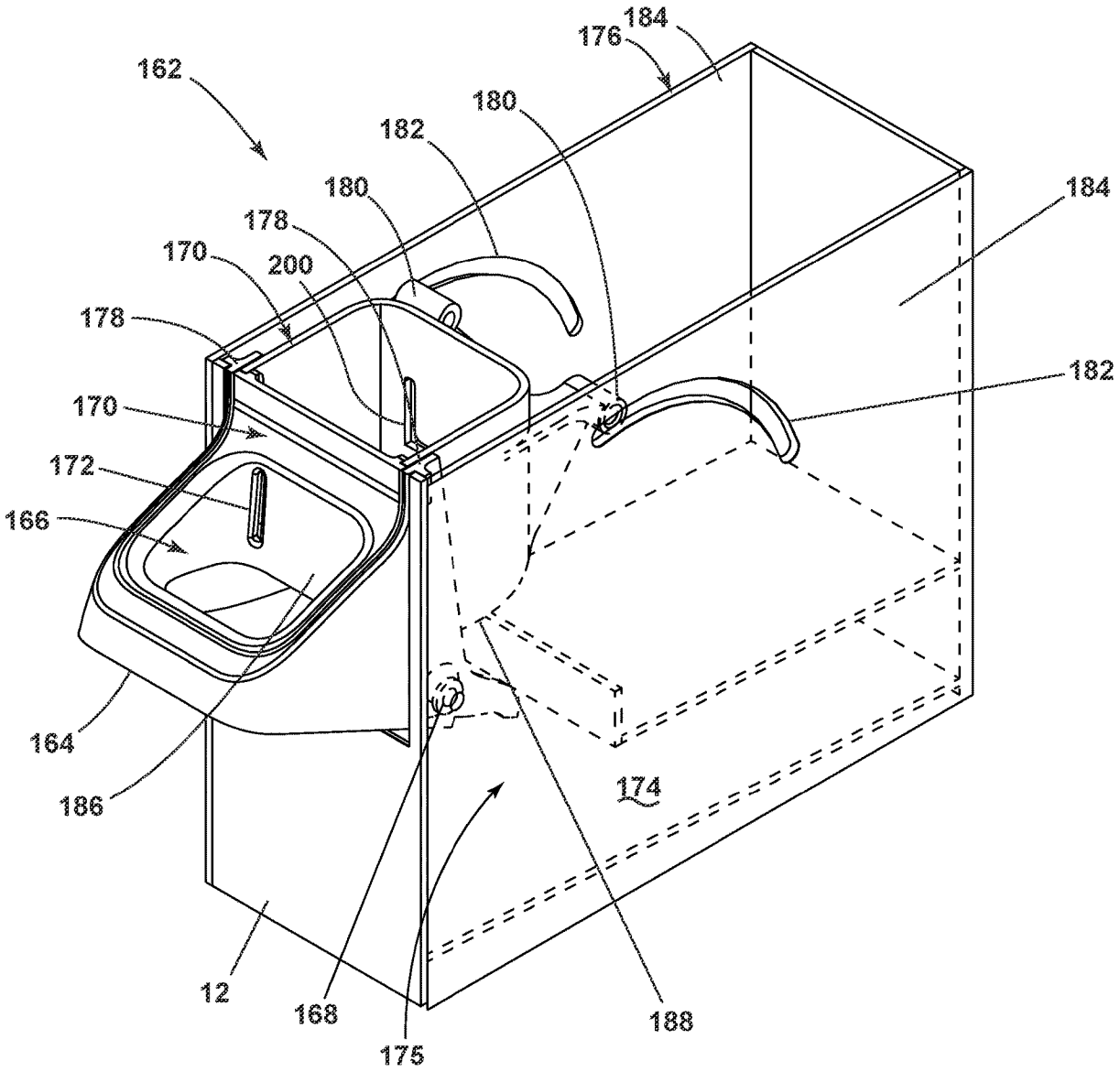
FIG. 3 illustrates a perspective view of a dispenser in an opened position that can be included in the laundry treating appliance of FIG. 1 according to a first embodiment of the present disclosure.

Referring now to FIG. 3, a perspective view of a specific implementation of a dispenser 162 according to a first embodiment is shown, which can be used for the dispenser 62 of FIG. 1. The dispenser 162 can be at least partially defined by a dispenser housing 176. The dispenser 162 can have a door 164 that is movable between an opened and a closed position to selectively allow presentation of an access opening 166 and a single dose reservoir, illustrated herein as a cup 170, to a user. The door 164 is pivotably mounted about a pivot axis 168. When the door 164 is in the opened position, as shown in FIG. 3, the access opening 166 is presented to a user such that treating chemistry can be poured through the access opening 166 and into the cup 170.

The cup 170 is pivotably connected to the door 164 at a pivot point 178. The attachment of the cup 170 to the door 164 allows the cup 170 to be movable relative to the dispenser housing 176. The cup 170 is provided with pins 180 that can move within guide tracks 182 that are provided within the side walls 184 of the dispenser housing 176. The movement of the pins 180 within the guide tracks 182 allow for a bottom wall 188 of the cup 170 to remain horizontal in all positions. The cup 170 is further provided with an indicia 172. The indicia 172 is located on a front surface 186 of the cup 170 such that it can be easily viewed by a user. The indicia 172 indicates a maximum fill level for the single dose reservoir of the cup 170. The indicia 172 can also indicate an overfill level. The cup 170 can also include an overflow 200, which can be a through opening provided in a sidewall 190 of the cup 170.

The dispenser 162 can also include a bulk dispensing reservoir 174. In an exemplary embodiment, the bulk dispensing reservoir 174 is located within a lower portion of the dispenser housing 176 and is at least partially defined by the dispenser housing 176. The bulk dispensing reservoir 174 can have an open top 175 that is in fluid communication with the dispenser housing 176. When the dispenser 162 is in the opened position as shown in FIG. 3, the cup 170 overlies the open top 175 of the bulk dispensing reservoir 174 and is slidably movable relative to the bulk dispensing reservoir 174. While the bulk dispensing reservoir 174 has been illustrated herein as being adjacent to and below the cup 170, it will be understood that the bulk dispensing reservoir 174 could be positioned in any other suitable location within the washing machine 10, with the cup 170 being fluidly coupled to the bulk dispensing reservoir 174 by a conduit (FIG. 6).

Figure 4:
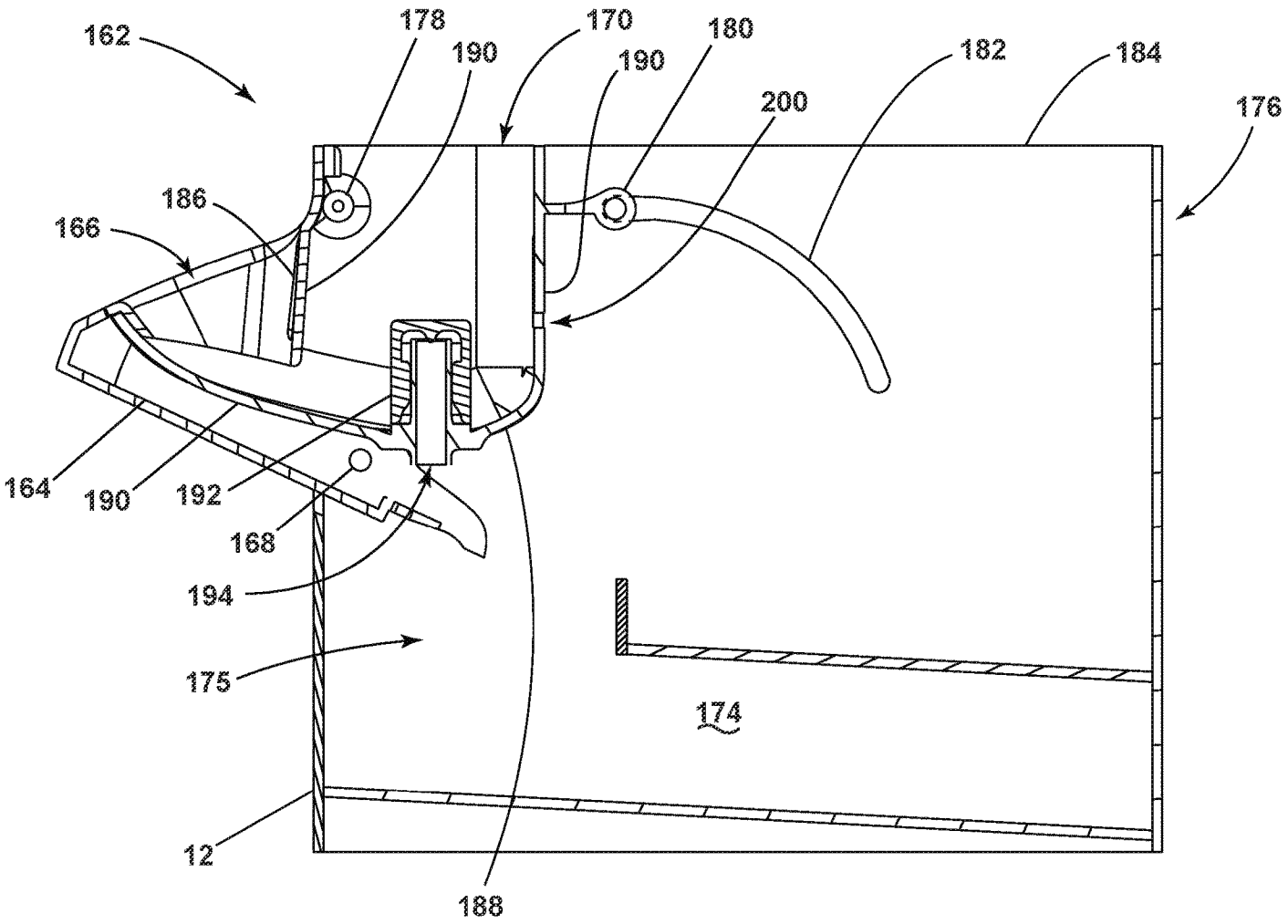
FIG. 4 illustrates a schematic cross-sectional view of a dispenser of FIG. 3 in an opened position.

FIG. 4 illustrates a cross-sectional view of the dispenser 162 of FIG. 3 in the opened position. The cup 170 has a bottom wall 188 and sidewalls 190. Within a sidewall 190 of the cup 170 is located an overflow 200, that comprises a physical portion of the cup 170. The cup 170 can further include a siphon tube 192 that comprises a physical portion of the cup 170. More specifically, the siphon tube 192 extends from the bottom wall 188 and/or sidewalls 190 of the cup 170 and has an outlet 194. The overflow 200 and the outlet 194 of the siphon tube 192 overlie the bulk dispensing reservoir 174 when the dispenser 162 is in the opened position and fluidly couple the cup 170 to the bulk dispensing reservoir 174. In an exemplary embodiment, the overflow 200 is located at a height that is substantially equal to the uppermost height of the siphon tube 192. The single dose maximum fill line as indicated by the indicia 172 is selected such that it is lower than both the height of the siphon tube 192 and the overflow 200.

Figure 5:
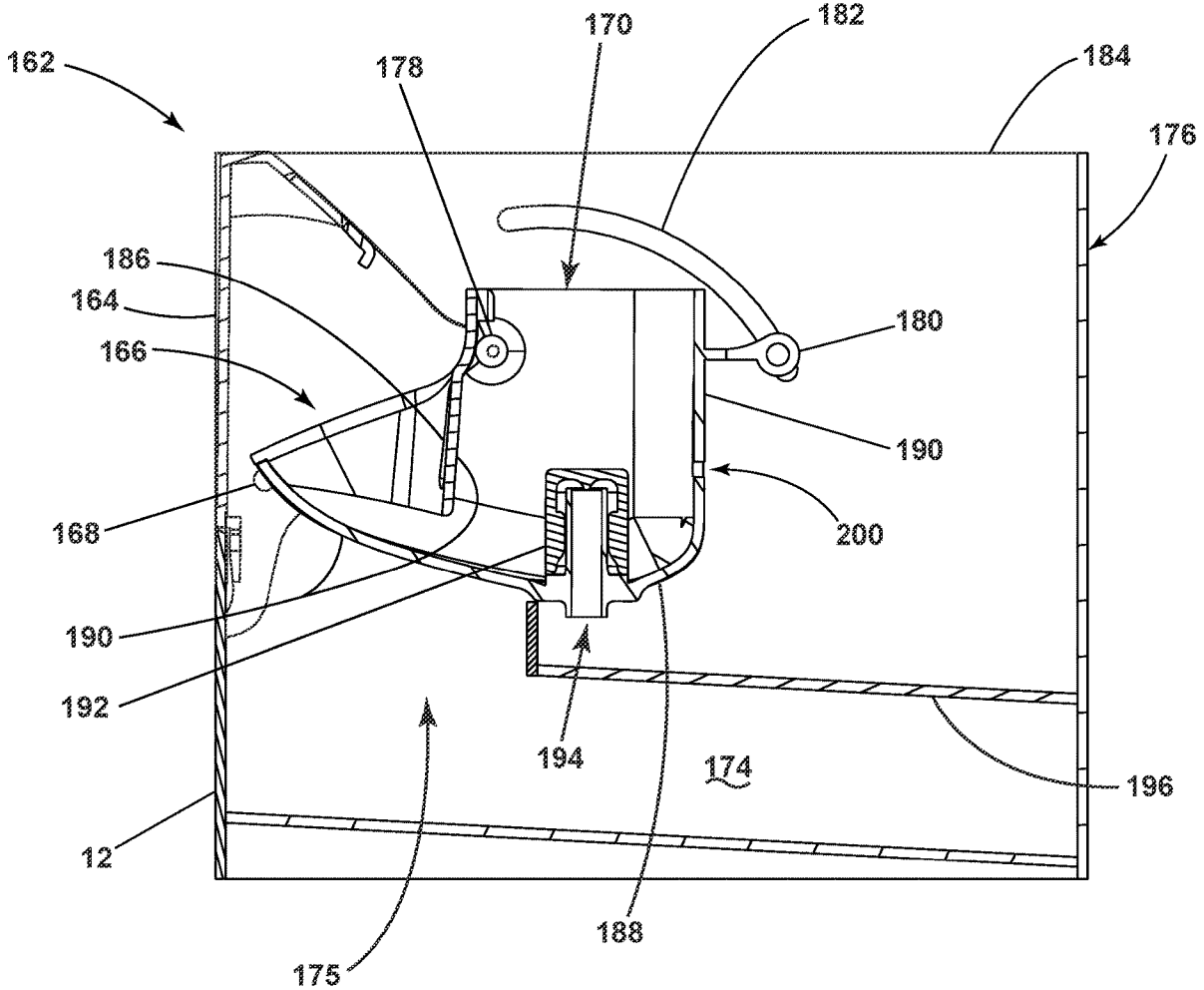
FIG. 5 illustrates a schematic cross-sectional view of the dispenser of FIG. 3 in a closed position.

FIG. 5 illustrates a cross-sectional view of the dispenser 162 of FIG. 3 in a closed position. When the dispenser 162 is in the closed position, the cup 170 is shifted towards the rear of the dispenser housing 176 such that the overflow 200 and the outlet 194 of the siphon tube 192 no longer overlie the bulk dispensing reservoir 174, but rather overlie a ledge 196 that has an outlet (not shown) in fluid communication with the treating chamber 18. The door 164 can be flush with the cabinet 12 when the dispenser 162 is in the closed position.

Figure 6:
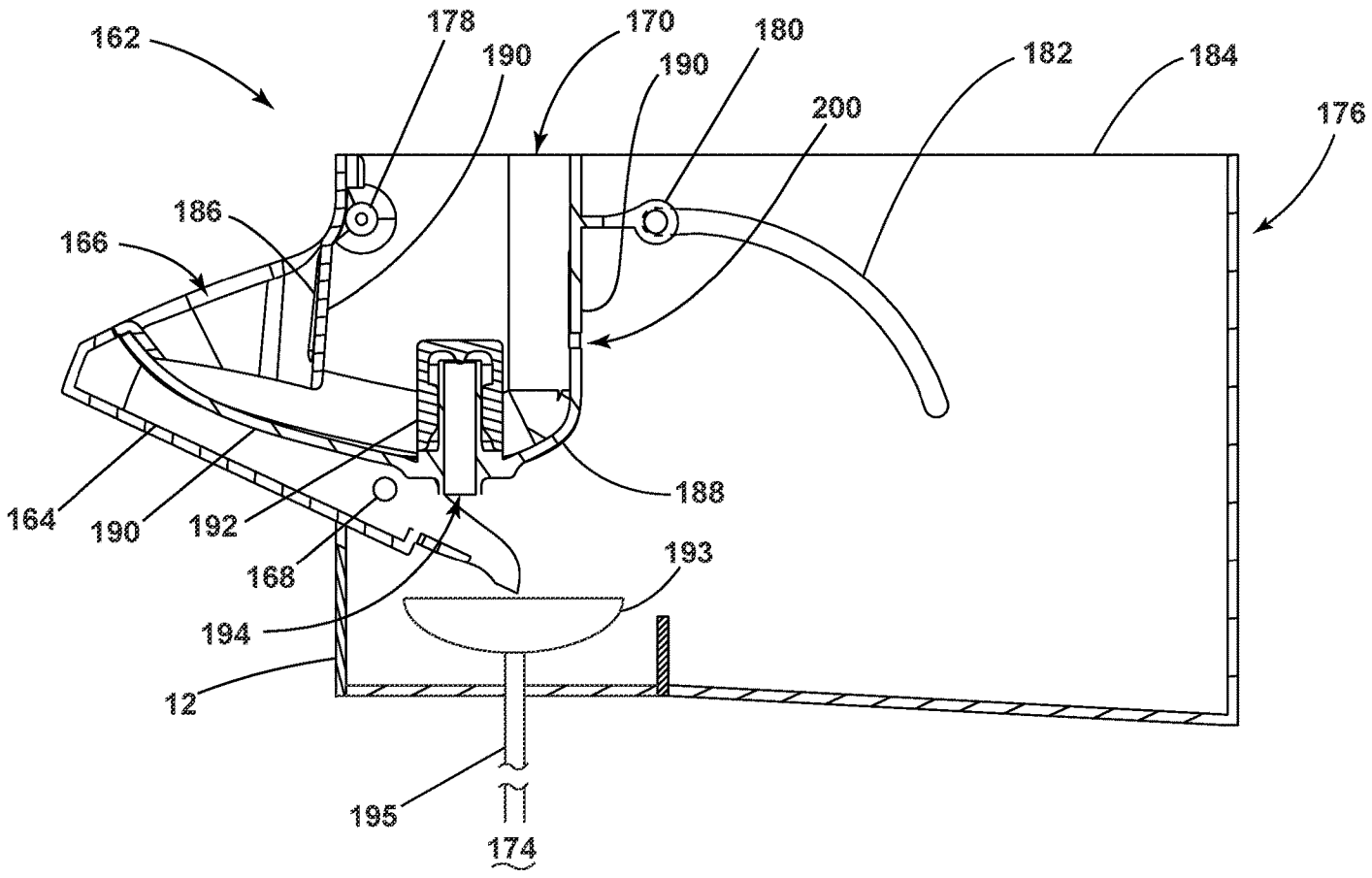
FIG. 6 illustrates a schematic cross-sectional view of a dispenser of FIG. 4 in an opened position according to a second embodiment of the present disclosure.

FIG. 6 illustrates a cross-sectional view of the dispenser 162 of FIG. 4 in an opened position according to a second embodiment of the present disclosure. The embodiment of FIG. 6 is identical to the embodiment of FIG. 4 with the exception that the bulk dispensing reservoir 174 is located remotely from the cup 170, at another location within the washing machine 10. Rather than directly overlying the bulk dispensing reservoir 174, the overflow 200 and the outlet 194 of the siphon tube 192 overlie a funnel 193 that is fluidly coupled to the remotely located bulk dispensing reservoir 174 via a conduit 195.

Turning now to the operation of the dispenser 162 when the dispenser 162 is in the opened position (FIG. 3, FIG. 4, FIG. 6), the access opening 166 is presented to the user. The user can then add a treating chemistry through the access opening 166 and into the cup 170. As the cup 170 fills with the treating chemistry, the indicia 172 will indicate that the fill level in the cup is rising. If the cup 170 is filled to at or below the single dose maximum fill line as shown by the indicia 172, the treating chemistry will remain in the cup when the dispenser 162 is moved to the closed position (FIG. 5). During the automatic cycle of operation, liquid will flow through the dispensing supply conduit 68 and into the dispenser 162. When the liquid causes the fill level in the cup 170 to exceed the height of the siphon tube 192 and the overflow 200, liquid will flow out of the cup 170 through the overflow 200 and onto the ledge 196. The siphon tube 192 is also activated such that the contents of the cup 170 are siphoned out through the outlet 194 of the siphon tube 192. The contents flow through the outlet 194 of the siphon tube 192 and onto the ledge 196. The contents then exit the ledge 196 through an outlet (not shown) that allows the liquid and treating chemistry to be guided through the dispensing outlet conduit 64 and into fluid communication with the treating chamber 18.

In the case that the cup 170 is filled beyond the single dose maximum fill line and up to or beyond the overfill level line as indicated by the indicia 172 when the dispenser 162 is in the opened position (FIGS. 3, 4, and 6), overfilling the cup 170, the overflow 200 and the siphon tube 192 are activated. The contents of the cup 170 will then flow through the overflow 200 and through the siphon tube 192, through the outlet 194, and into the bulk dispensing reservoir 174. Filling of the bulk dispensing reservoir 174 will continue until the cup 170 has been emptied. If a user continues to fill the cup 170 after the siphon tube 192 has been activated, the contents of the cup 170 will continue to be siphoned through the siphon tube 192 and fill the bulk dispensing reservoir 174 until the user stops filling the cup 170. In the case that the bulk dispensing reservoir 174 is located remotely from the cup 170, at another location within the washing machine 10 (FIG. 6), the contents of the cup 170 can flow through the overflow 200 and the siphon tube 192, through the outlet 194, and then be collected in the funnel 193 to flow through the conduit 195 in order to fill the bulk dispensing reservoir 174 when the cup 170 is overfilled.

Figure 7:
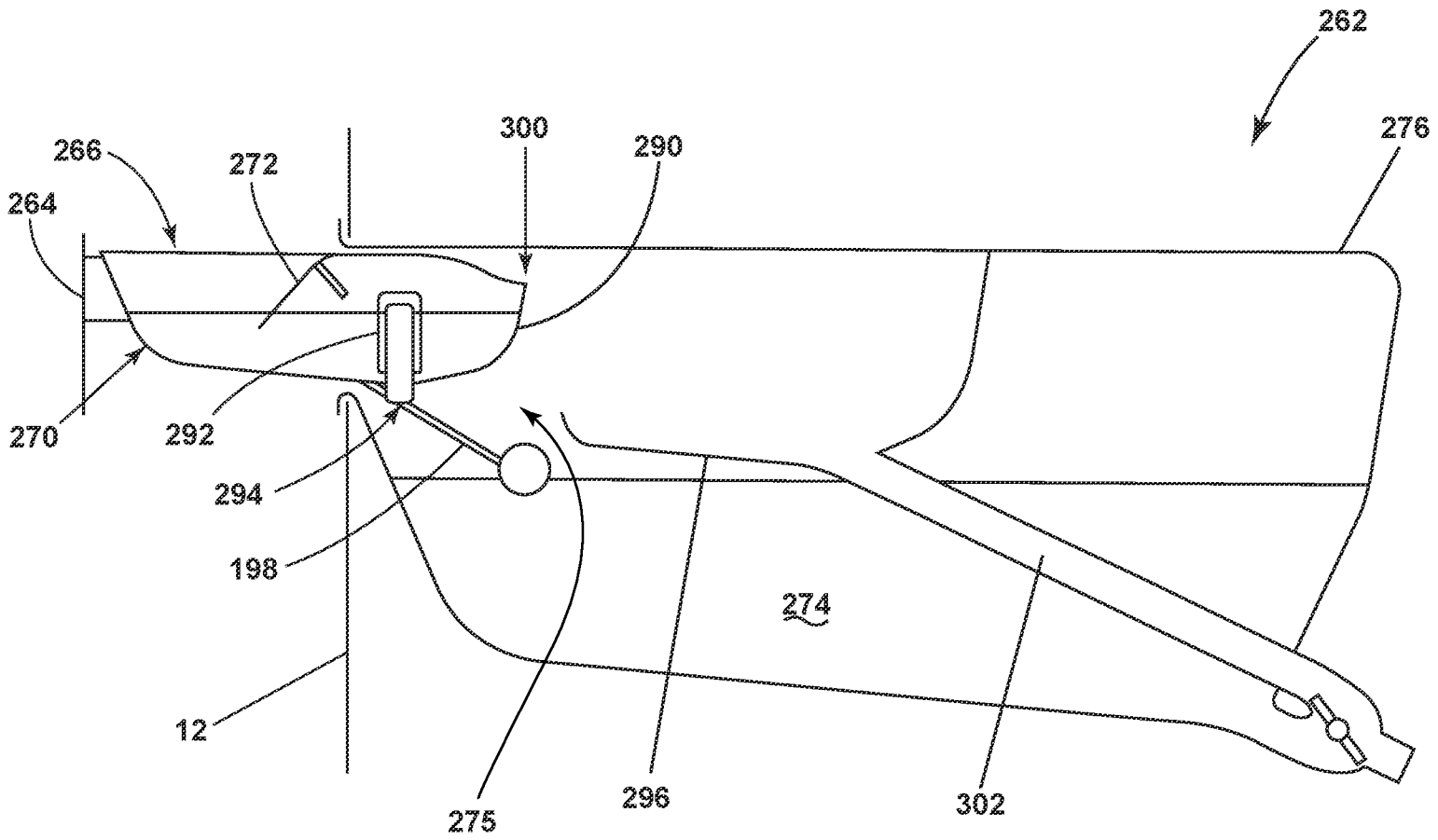
FIG. 7 illustrates a schematic cross-sectional view of a dispenser in an opened position that can be included in the laundry treating appliance of FIG. 1 according to a third embodiment of the present disclosure.

Referring now to FIG. 7, a schematic cross-sectional view of a dispenser 262 in an opened position according to a third embodiment is shown. The third embodiment is similar to the first embodiment; therefore, like parts will be identified with like numerals increased by 100, with it being understood that the description of the like parts of the first embodiment applies to the third embodiment, unless otherwise noted. The dispenser 262 is mounted within the cabinet 12 for slidable movement relative to the cabinet 12 and relative to the bulk dispensing reservoir 274. The cup 270 has a siphon tube 292 as well as an overflow portion 300. The overflow portion 300 comprises a physical portion of the sidewall 290 of the cup 270 that has a reduced height. In an exemplary embodiment, the reduced height of the overflow portion 300 has approximately the same height or a slightly taller height then the top of the siphon tube 292. The cup 270 can be further provided with a float 198 to determine the level of liquid in the bulk dispensing reservoir 274. When the dispenser 262 is in the opened position, the outlet 294 of the siphon tube 292, as well as the overflow portion 300 of the cup 270, overlies the open top 275 of the bulk dispensing reservoir 274. While the bulk dispensing reservoir 274 has been illustrated herein as being adjacent to and below the cup 270, it will be understood that the bulk dispensing reservoir 274 could be positioned in any other suitable location within the washing machine 10, with the cup 270 being fluidly coupled to the bulk dispensing reservoir 274 by a conduit (FIG. 9).

Figure 8:
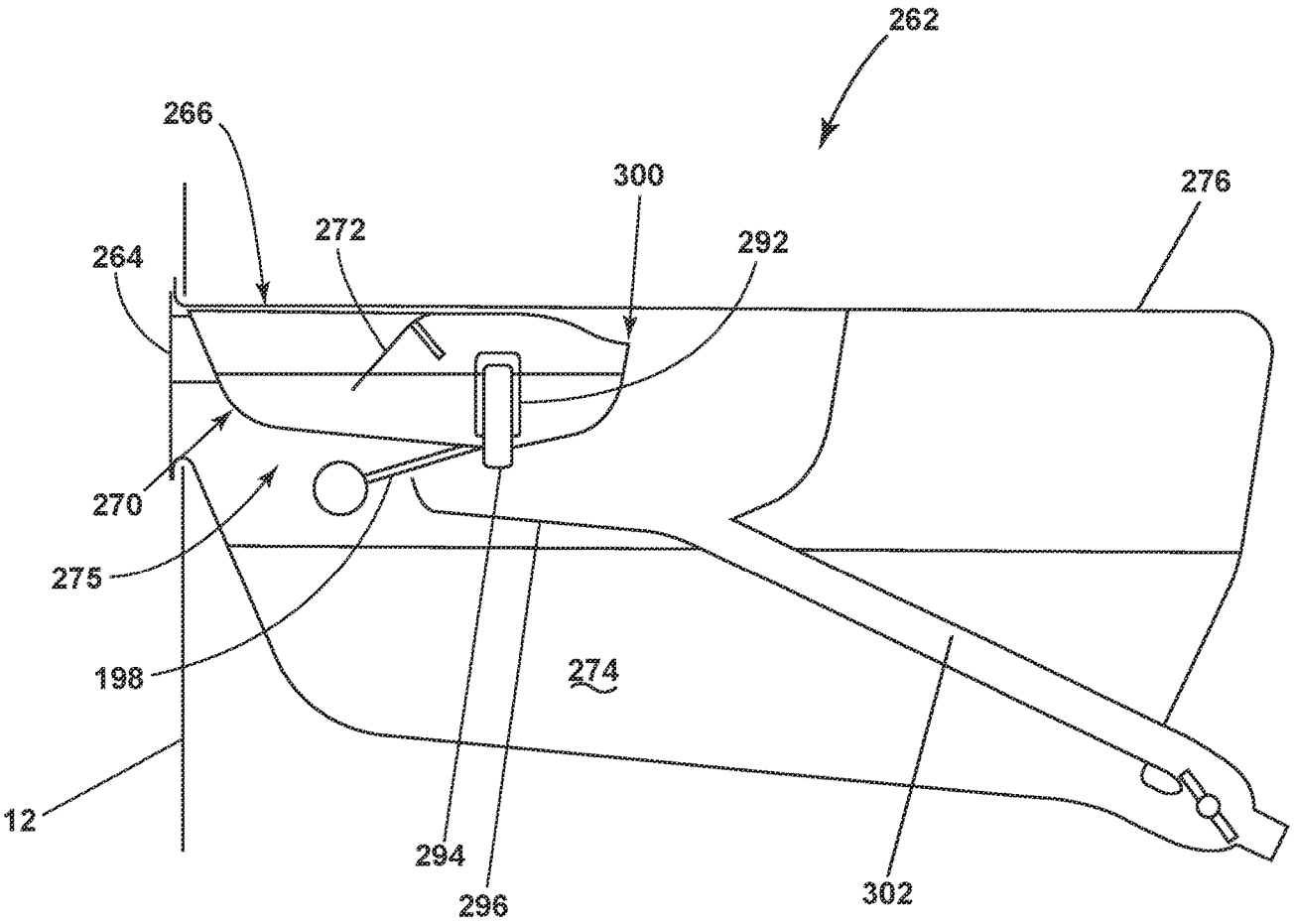
FIG. 8 illustrates a schematic cross-sectional view of the dispenser of FIG. 7 in a closed position.

FIG. 8 is schematic cross-sectional view of the dispenser 262 of FIG. 7 in a closed position. When the dispenser 262 is in the closed position, the cup 270 is shifted towards the rear of the dispenser housing 276. The float 198 rests on the ledge 296. In the closed position, the outlet 294 of the siphon tube 292, as well as the overflow portion 300 of the cup 270, no longer overlie the open top 275 of the bulk dispensing reservoir 274, but rather overlie the ledge 296 that has an outlet 302 in fluid communication with the treating chamber 18.

Figure 9:
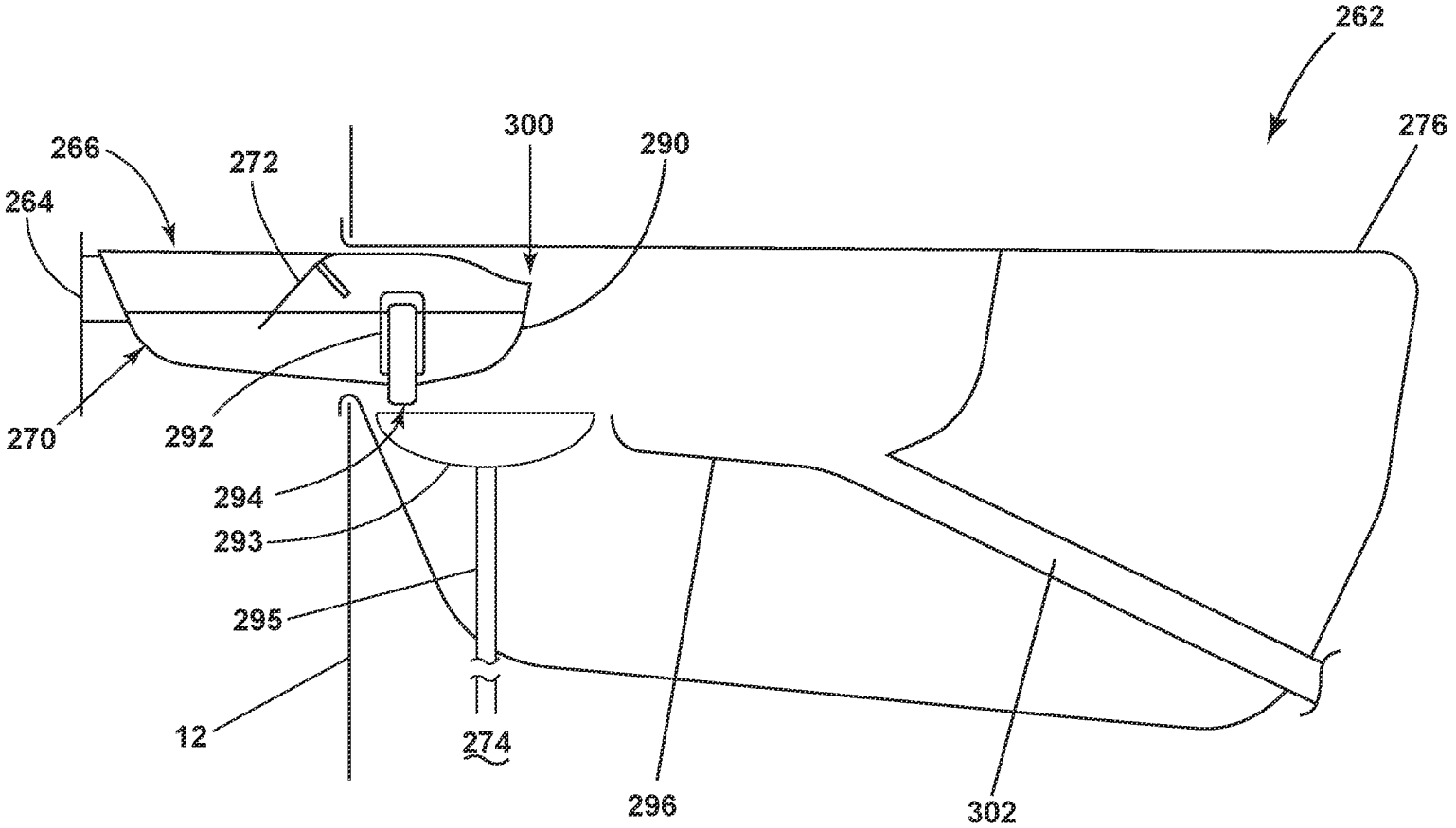
FIG. 9 illustrates a schematic cross-sectional view of a dispenser of FIG. 7 in an opened position according to a fourth embodiment of the present disclosure.

FIG. 9 illustrates a schematic cross-sectional view of the dispenser 262 of FIG. 7 in an opened position according to a fourth embodiment of the present disclosure. The embodiment of FIG. 9 is identical to the embodiment of FIG. 7 with the exception that the bulk dispensing reservoir 274 is located remotely from the cup 270, at another location within the washing machine 10. Rather than directly overlying the bulk dispensing reservoir 274, the overflow portion 300 and the outlet 294 of the siphon tube 292 overlie a funnel 293 that is fluidly coupled to the remotely located bulk dispensing reservoir 274 via a conduit 295.

Turning now to the operation of the dispenser 262 when the dispenser 262 is in the opened position (FIG. 7 and FIG. 9), the access opening 266 is presented to the user. The user can then add a treating chemistry through the access opening 266 and into the cup 270. As the cup 270 fills with the treating chemistry, the indicia 272 will indicate that the fill level in the cup is rising. If the cup 270 is filled to at or below the single dose maximum fill line as shown by the indicia 272, the treating chemistry will remain in the cup when the dispenser 262 is moved to the closed position (FIG. 8). During the automatic cycle of operation, liquid will flow through the dispensing supply conduit 68 and into the dispenser 262. When the liquid causes the fill level in the cup 270 to exceed the height of the siphon tube 292, the siphon tube 292 is activated and the contents of the cup 270 are siphoned out through the outlet 294 of the siphon tube 292. The contents flow through the outlet 294 of the siphon tube 292 and onto the ledge 296. The contents can also flow over the overflow portion 300 of the cup 270 and onto the ledge 296. The contents then exit the ledge 296 through an outlet 302 that allows the liquid and treating chemistry to be guided through the dispensing outlet conduit 64 and into fluid communication with the treating chamber 18.

In the case that the cup 270 is filled beyond the single dose maximum fill line and up to or beyond the overfill level line as indicated by the indicia 272 when the dispenser 262 is in the opened position (FIGS. 7 and 9), overfilling the cup 270, the siphon tube 292 is activated. The contents of the cup 270 will then flow through the siphon tube 292, through the outlet 294, and into the bulk dispensing reservoir 274. The contents of the cup 270 can also flow over the overflow portion 300 and into the bulk dispensing reservoir 274. Filling of the bulk dispensing reservoir 274 will continue until the cup 270 has been emptied. If a user continues to fill the cup 270 after the siphon tube 292 has been activated, the contents of the cup 270 will continue to be siphoned through the siphon tube 292 and fill the bulk dispensing reservoir 274 until the user stops filling the cup 270. In the case that the bulk dispensing reservoir 274 is located remotely from the cup 270, at another location within the washing machine 10, the contents of the cup 270 can flow through the overflow portion 300 and the siphon tube 292, through the outlet 294, and then be collected in the funnel 293 to flow through the conduit 295 such that the conduit 195 is used to fill the bulk dispensing reservoir 274 when the cup 270 is overfilled.

The embodiments disclosed herein provide an integrated single dose and bulk dispenser for a laundry treating appliance. One advantage that can be realized in the above embodiments is that the above described embodiments are configured to provide an integrated single dose and bulk dispenser that eliminated the need for two pour zones. When two separate, rather than integrated, dispensers are provided for single dose dispensing and bulk dispensing, there are increased manufacturing requirements to provide two pour zones. In addition, a user may find it cumbersome to switch back and forth between the two pour zones. By employing the embodiments disclosed herein for an integrated single dose and bulk dispenser, ease of use for a user is improved, as well as simplification of the manufacturing of only a single necessary pour zone.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the present disclosure has been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A laundry treating appliance for treating laundry according to an automatic cycle of operation, the laundry treating appliance comprising:

a treating chamber;

a bulk treating chemistry reservoir;

a dispenser fluidly coupled to the treating chamber and movable between an opened position and a closed position, the dispenser comprising:

a single dose reservoir having at least a bottom wall and a side wall; and an overflow provided within the bottom wall or the side wall and overlying the bulk treating chemistry reservoir when the dispenser is in the opened position and wherein the bulk treating chemistry reservoir can be filled by overfilling the single dose reservoir when the dispenser is in the opened position.

2. The laundry treating appliance of claim 1 wherein the bulk treating chemistry reservoir is physically remote from the dispenser.

3. The laundry treating appliance of claim 1 wherein the overflow comprises a physical portion of the single dose reservoir.

4. The laundry treating appliance of claim 3 wherein the physical portion comprises a wall of the single dose reservoir.

5. The laundry treating appliance of claim 4 wherein the single dose reservoir is a cup having a sidewall, with at least a portion of the sidewall forming the wall.

6. The laundry treating appliance of claim 5 wherein the wall defining the overflow has a height less than the height of the side wall defining single dose reservoir.

7. The laundry treating appliance of claim 1 further comprising a siphon tube located within the single dose reservoir, which siphons contents of the single dose reservoir into the bulk treating chemistry reservoir ledge when the single dose reservoir is overfilled.

8. The laundry treating appliance of claim 7 wherein the overflow further comprises a physical portion of the single dose reservoir over which the contents of the single dose reservoir will flow when overfilled.

9. The laundry treating appliance of claim 8 wherein the physical portion comprises a wall of the single dose reservoir.

10. The laundry treating appliance of claim 9 wherein the wall defining the overflow has a height less than the height of the side wall defining single dose reservoir.

11. The laundry treating appliance of claim 1 further comprising a float configured to determine a level of liquid in the bulk reservoir.

12. The laundry treating appliance of claim 11 wherein the float is pivotally mounted on the dispenser.

13. The laundry treating appliance of claim 1 wherein the single dose reservoir is movable relative to the bulk treating chemistry reservoir.

14. A dispenser movable between an opened position and a closed position, the dispenser comprising:

a single dose reservoir having at least a bottom wall and a side wall;

a bulk treating chemistry reservoir located remotely from the single dose reservoir; and an overflow provided within the bottom wall or the side wall and overlying the bulk treating chemistry reservoir when the dispenser is in the opened position and wherein the bulk treating chemistry reservoir can be filled by overfilling the single dose reservoir when the dispenser is in the opened position.

15. The dispenser of claim 14 wherein the overflow comprises a physical portion of the single dose reservoir.

16. The dispenser of claim 15 wherein the physical portion comprises a wall of the single dose reservoir.

17. The dispenser of claim 16 wherein the single dose reservoir is a cup having a sidewall, with at least a portion of the sidewall forming the wall.

18. The dispenser of claim 17 wherein the wall defining the overflow has a height less than the height of the side wall defining single dose reservoir.

19. The dispenser of claim 14 further comprising a siphon tube located within the single dose reservoir, which siphons contents of the single dose reservoir into the bulk treating chemistry reservoir ledge when the single dose reservoir is overfilled.

20. The dispenser of claim 14 further comprising a float configured to determine a level of liquid in the bulk reservoir.

* * * * *